United States Patent [19]

Zinck et al.

[11] Patent Number: 4,723,457

[45] Date of Patent: Feb. 9, 1988

[54] SUDDEN INTERLOCKING AND TELEUNLOCKING MECHANICAL ASSEMBLY FOR A TRANSLATION SWITCH HAVING AUTOMATIC REINFORCED INTERLOCKER

[75] Inventors: Robert R. Zinck; Jacques J. Siat, both of Benfeld, France

[73] Assignee: Scoiete Anonyme Dite Socomec, Benfeld, France

[21] Appl. No.: 696,501

[22] Filed: Jan. 30, 1985

Related U.S. Application Data

[63] Continuation-in-part of Ser. No. 467,489, filed as PCT FR 82/00090 on May 28, 1982, published as WO 82/04496 on Dec. 23, 1982, abandoned.

[30] Foreign Application Priority Data

Jun. 10, 1981 [FR] France ..... 81 11552
Dec. 18, 1984 [FR] France ..... 84 19496

[51] Int. Cl.[4] ..... H01H 3/30; H01H 73/38

[52] U.S. Cl. ..... 74/100 R; 74/2; 74/520; 200/78; 200/153 G

[58] Field of Search ..... 74/520, 2, 106, 97, 74/100 R; 200/153 G, 67 A, 78

[56] References Cited

U.S. PATENT DOCUMENTS

| | | | |
|---|---|---|---|
| 2,447,137 | 8/1948 | Runke | 74/2 |
| 2,580,511 | 1/1952 | Brancho | 74/2 |
| 2,794,881 | 6/1957 | Frank | 74/2 |
| 2,848,575 | 8/1958 | Hahn | 200/78 |
| 2,995,043 | 8/1961 | Lusk et al. | 74/97 |
| 3,150,243 | 9/1964 | Hermann | 200/67 A |
| 3,184,989 | 5/1965 | Rhodes | 74/97 |
| 3,187,593 | 6/1965 | McCloud | 74/520 |
| 3,312,805 | 4/1967 | Bury | 200/78 |
| 3,349,208 | 10/1967 | Cataldo et al. | 200/153 G |
| 3,470,750 | 10/1969 | Wetter | 74/2 |
| 3,614,358 | 10/1971 | Hermann | 200/67 A |
| 3,621,189 | 11/1971 | Link et al. | 200/153 G |
| 3,754,108 | 8/1973 | Marot et al. | 200/153 G |
| 3,796,845 | 3/1974 | Shirae | 200/153 G |
| 4,146,765 | 3/1979 | Wilson | 74/2 |
| 4,166,205 | 8/1979 | Maier et al. | 200/153 G |
| 4,219,713 | 8/1980 | Maier et al. | 200/153 G |

FOREIGN PATENT DOCUMENTS

| | | | |
|---|---|---|---|
| 194958 | 7/1956 | Austria | 200/78 |
| 521215 | 7/1953 | Belgium | 200/78 |
| 601653 | 7/1960 | Canada | 200/153 G |
| 608263 | 11/1960 | Canada | 200/78 |
| 601429 | 8/1934 | Fed. Rep. of Germany | 200/67 A |
| 1031869 | 6/1958 | Fed. Rep. of Germany | 200/78 |
| 1765380 | 9/1971 | Fed. Rep. of Germany | . |
| 2505452 | 8/1975 | Fed. Rep. of Germany | 200/153 G |
| 1137406 | 5/1957 | France | 200/153 G |
| 1364469 | 5/1964 | France | 200/153 G |
| 1370745 | 7/1964 | France | . |
| 1542042 | 9/1968 | France | 200/153 G |
| 1591048 | 5/1970 | France | . |
| 2040860 | 1/1971 | France | . |
| 2277995 | 3/1976 | France | 74/2 |
| 197171 | 5/1923 | United Kingdom | 200/67 A |

*Primary Examiner*—Lawrence Staab
*Attorney, Agent, or Firm*—Erwin S. Teltscher

[57] ABSTRACT

The sudden interlocking and unlocking mechanism of a translation switch comprises a spring interlocking and spring unlocking rocking device associated in line with a toggle joint mechanism used as interlocker. According to one characteristic of the invention the mechanical assembly of the translation switch includes a remote unlocking mechanism. According to another characteristic, the unlocking energy is used to automatically replace the toggle joint mechanism and its composite elements in position ready for engagement of the switch, that is, in position in which the articulation points of the mechanical assembly are aligned in the phase preceding the interlocking operation.

10 Claims, 14 Drawing Figures

SUDDEN INTERLOCKING AND TELEUNLOCKING MECHANICAL ASSEMBLY FOR A TRANSLATION SWITCH HAVING AUTOMATIC REINFORCED INTERLOCKER

The present invention is a continuation-in-part application of U.S. application Ser. No. 467,489, filed as PCT FR82/00090 on May 28, 1982, published as WO82/04496 on Dec. 23, 1982, abandoned, in the name of Messrs. Jacques SIAT and Robert ZINCK.

BACKGROUND OF THE INVENTION

The invention relates to an improved mechanical assembly to accomplish sudden interlocking and unlocking of a translation switch. This assembly allows for automatic reinforcement after interlocking and before re-interlocking of the switch.

The main purpose of this mechanical assembly is to provide improvements in the field of switches for industrial use, having translation contact movement.

Translation switches are valued for their short circuit bearing current because they have the important advantage of possessing a lateral contact supply between the two clamps, in the manner of pliers.

This characteristic assures perfect contact, true and complete from the beginning of engagement of the two pieces, and suppresses rebounds and flutter found with other types of contacts during peak currents.

For security purposes, those switches have been provided with interlocking and unlocking actuating mechanisms, the principal characteristics of which were to decrease manual force to be exerted on the handle that causes reinterlocking.

Numerous spring mechanisms provide for sudden interlocking and unlocking. For instance, there are mechanisms described in the Canadian Pat. No. 601,653 TURNER, and in the following U.S. Pat. Nos.: 2,995,043 LUSK, 3,614,358 HERMANN, 3,621,189 LINK, 4,146,765 WILSON, 4,166,205 MAIER, 4,219,713 MAIER and RICCI, where a combination of return forces of various springs renders it possible to obtain fast release of energy for a sudden interlocking or unlocking.

But, in most of them, it is a question of interlocking or unlocking the respective switches by a rotary motion for which the application of spring action is facilitated by the use of pivoting levers.

These complex mechanisms are costly to manufacture and to install and do not produce efficient performance which is sought after.

Other embodiments utilize mechanisms comprising an elbow or toggle joint or similar devices. For instance, German Pat. No. 601429 Anton WORNER, French Pat. Nos. 1,137,406 THOMSON-HOUSTON, 1,542,042, ELLENBERGER, and U.S. Pat. Nos. 2,794,881 FRANK, 3,187,593 Mac CLOUD, 3,796,845 SCHIRAE.

In those embodiments, spring compression between the initial position and the mid point causes abrupt seesaw motion towards the opposite position.

Even though this type of mechanism, when applied to a lateral displacement switch, makes it possible to benefit from all advantages of this type of switch, it nevertheless exhibits, besides the disadvantages of purely manually operated switch needing a certain effort for its operation, a limited performance insufficient in certain cases of use.

In fact, only the transverse component of the elastic force of the spring can be exploited for the seesaw motion. Yet, this transverse component has only a small part of its total value in the neighborhood of the dead center.

Consequently, those switches have an interlocking or unlocking speed limited by the inherent characteristics of this type of mechanism. Moreover, this type of switch cannot be provided with a remote control unlocking device because of the considerable control energy which would have to be used to rotate this mechanism.

Furthermore, devices exist allowing for collapsing an alignment of several pivoting axles of pushing or return mechanisms. Those devices are called toggle joint mechanisms. Two embodiments are described in U.S. Pat. Nos. 2,580,511 BRANCHU and 3,754,108 MAROT. Those devices comprise two main parts connected to each other and each joined at one of its extremities to a part of a mechanism in which the toggle joint mechanism is inserted. Equilibrium position corresponds to the alignment of those axes. An unlocking lever causes those axes to become misaligned, thus causing the collapse, that is, the opening by lateral displacement.

Remote control switches also exist, such as that described in French Pat. No. 1,137,406 THOMSON HOUSTON in which an electromagnetic coil retains a blocking lock of a complex mechanism having an elbow or toggle joint, the speed of movements of which, however, is not guaranteed.

SUMMARY OF THE INVENTION

The present invention relates to an improved mechanical assembly for sudden interlocking and unlocking of a translation switch with automatic reinforcement of unlocking before reengagement of the switch.

Remote control unlocking and automatic reinforcement of unlocking obviate the various disadvantages observed previously and confer to the switch an ease of use and superior performance for a translation switch claiming perfect rectilinear movements.

The toggle joint mechanism used in this assembly has been largely improved and modified to permit its automatic reinforcement solely by the unlocking energy.

The invention brings supplemental technical possibilities to this type of translation switch, such as remote control for unlocking with a small amount of energy and very interesting speed performances for unlocking and interlocking by a composite control mechanism utilizing, for each movement, the energy accumulated in a separate device.

To this effect and more precisely, the improved sudden interlocking and unlocking arrangement is characterized by the combination of a toggle joint mechanism with a reciprocating device biased in sudden transversal interlocking and unlocking motions by two opposite pusher means which are progressively energized and suddenly released, this combination further comprising rocking means for the toggle joint mechanism allowing for remote control of unlocking and its automatic reinstatement after unlocking.

The pre-reinforcing back movement of the control handle becomes no longer necessary because the control handle automatically gets back into position ready for unlocking.

According to this additional characteristic, unlocking energy is used to automatically replace the toggle joint mechanism and its composite elements in position ready for engagement of the switch, that is, in position in which the pivots of the mechanical assembly are aligned in the phase preceding the interlocking operation. In this position, the releasable lock mechanism is closed, that is, capable of transmitting the translation movement permitting compression of the interlocking spring. Then, it suffices to turn the handle in only one direction to accomplish interlocking of the switch.

According to another characteristic, the automatic opening of the releasable lock mechanism allows for controlling an attached signal element by which a user can verify the unlocking in a manner other than by observing the position of the control handle.

Thus, the assembly according to the invention gives multiple advantages to the translation switch so equipped, such as:

- remote control unlocking with low energy consumption,
- exceptionally high speed of unlocking and interlocking,
- the possibility of using the same unlocking electromechanical device for switches of different cutoff currents, even going to high values,
- the possibility of unlocking manually,
- the reduction in the operating force for interlocking because the spring interlocking force is not subjected to any resolution into a longitudinal component and another component transverse to the motion,
- self control avoiding any additional operation,
- speed for re-interlocking (reengagement) of the switch,
- speed of operation,
- minimizing shocks,
- removal of the re-engagement operation.

BRIEF DESCRIPTION OF THE DRAWING

Technical characteristics and other advantages of the invention are discussed in the following description, made as a non limiting example of particular embodiments, with reference to the accompanying drawing in which.

DETAILED DESCRIPTION OF THE PREFERRED EMBODIMENTS

Figure 1:
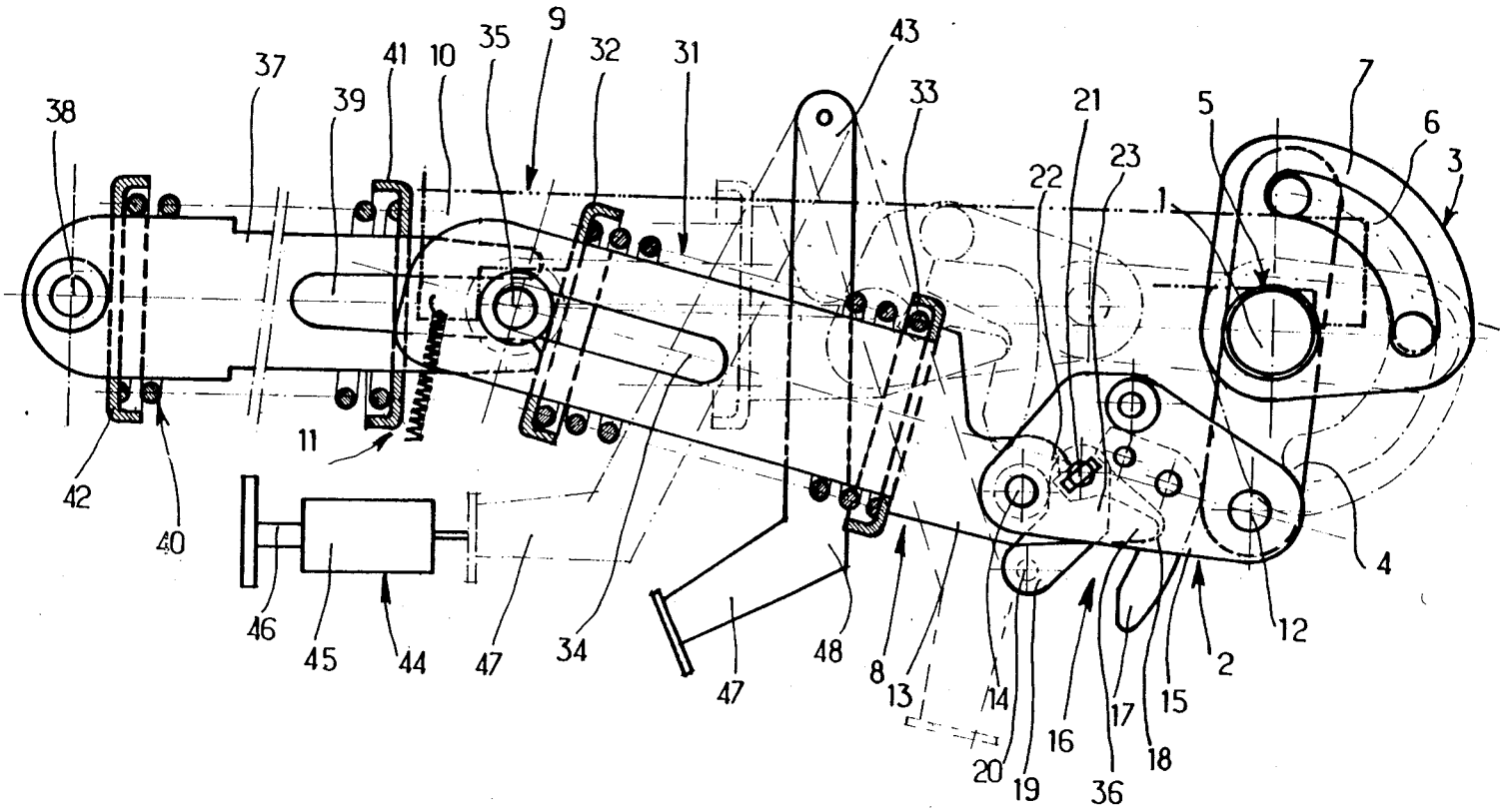
FIG. 1 is a general plan view of the sudden interlocking and unlocking complete mechanical assembly in unlocking position in which the improvement according to the invention is included.
Figure 2:
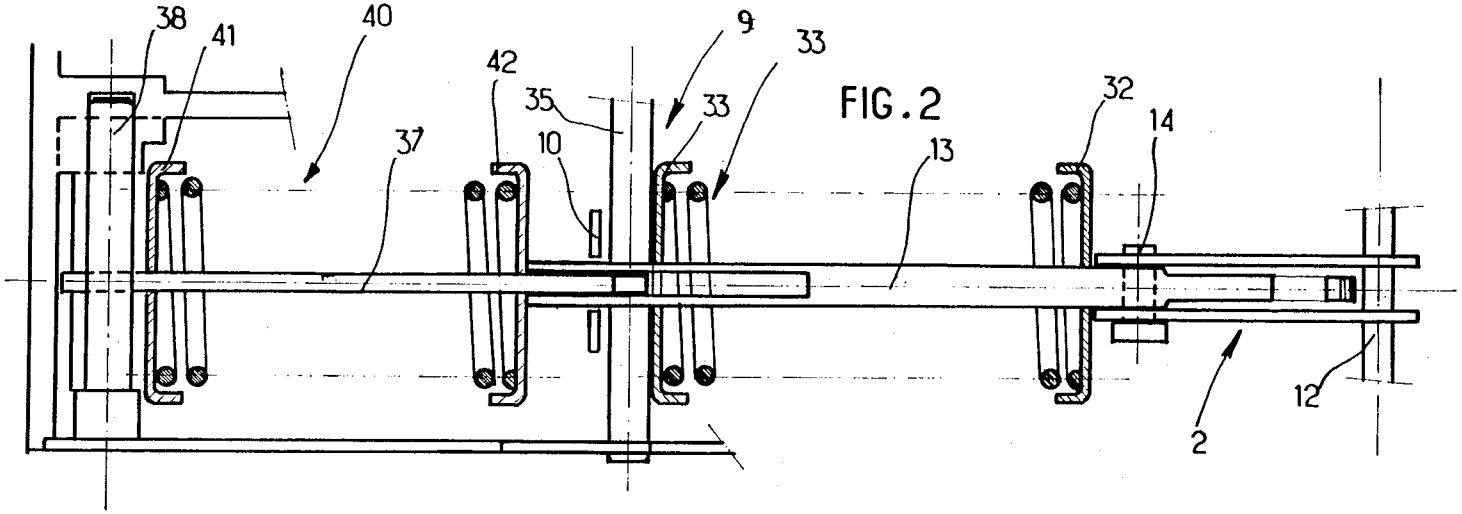
FIG. 2 is an elevational view of the interlocking and unlocking complete mechanical assembly.

Referring to FIG. 1, the mechanical assembly is manually activated by an operating handle integral with the control axle 1.

This axle 1, which is pivotally mounted on a platen and elastically returns towards the unlocking position, causes a rocking motion of a releasable lock mechanism which is referred to herein as a toggle joint mechanism 2 and which is controlled by means of a pivoting mechanical assembly 3. The toggle joint mechanism 2 as such may well be of any already known kind or any future equivalent means.

This toggle joint mechanism 2 is used as an interlocker and is constructed in such a manner as to allow for its automatic reengagement.

A first assembly of the toggle joint mechanism 2 comprises a driving lever 4 pivotally mounted on the control axle 1, for example by a socket 5. This lever 4 is hingedly mounted at one of its extremities on the toggle joint mechanism 2 and is guided at its other extremity in a curvilinear slot 6 provided in a pivoting sector 7 which is intergral with the control axle 1.

The toggle joint mechanism 2 is hingedly mounted in a mechanical assembly for compression and release, carried out by alignment of the elements of the composite mechanical arm in which it is inserted. The toggle joint mechanism 2 cooperates with a reciprocating device 9 for interlocking and unlocking, as an articulated connecting element allowing for alignment of the articulation points in the compression phase and for collapsing in the unlocking phase. It also cooperates, by pushing toward alignment, with a rocking retaining lever 10, retained in its holding position by a spring 11, which lever 10 releases suddenly the energy accumulated during the compression phase, in order to cause sudden interlocking. This lever 10 comprises a return extremity forming a front stop.

The toggle joint mechanism is preferably designed in the manner shown at FIG. 1. However, it could equally well have the technical characteristics of another embodiment, for instance that shown in FIG. 3, providing about the same results.

The toggle joint mechanism 2 is articulated, on the one hand, at the extremity of the operating lever 4, by an axle 12 and, on the other hand, at the extremity of an interlocking link 13, by means of an axle 14.

The toggle joint mechanism 2 being utilized is formed by two parallel plates, such as 15, carrying a blocking mechanism 16 which is constituted by the following elements: an elbow-shaped blocking lever 17 having a receiving notch 18, a pivoting unlocking lever 19 provided with an end lug 20, a locking transversal rectilinear element 21 cooperating, on the one hand, with the extremity of the blocking lever 17 and, on the other hand, with a receiving recess 22 having a release ramp 23 at the level of the extremity of the interlocking link 13.

Figure 3:
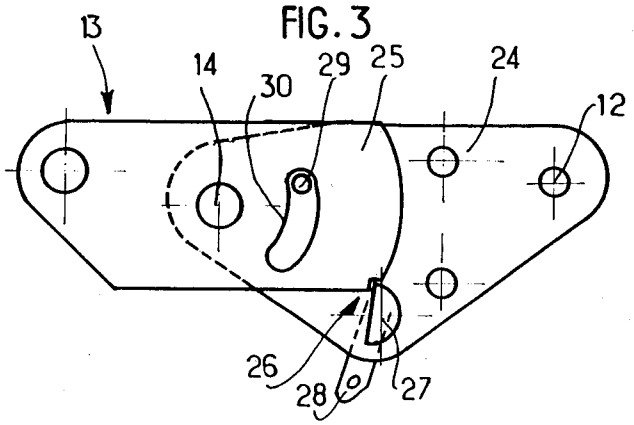
FIG. 3 shows, in plan view, a toggle joint mechanism of another type.

The other type of toggle joint mechanism, which is shown in FIG. 3, does not differ basically from the one already described.

It is composed of two bearings 24, and of two joint axles 12 and 14 by which the toggle joint mechanism 2 is interposed within the compression and release mechanical assembly 8.

The end of the interlocking link 13 has an enlarged portion 25 which includes a corner notch 26 in which the end of a blocking element 27, which is integral with an unlocking pivoting lever 28, is fitted. The operating principle is the same.

To limit the magnitude of the collapsing motion, a stop pin 29 moving in a curvilinear slot 30 has been provided here, on the extremity of the interlocking link 13.

The interlocking link 13 bears an interlocking spring 31 maintained between two end supports 32 and 33. The link 13 comprises a longitudinal slot 34 cooperating with the axle 35 of the reciprocating device 9 which moves the contact bearing movable equipment between the interlocking position and the locking position.

The link 13 has a pointed shape at its forward extremity that is articulated on the toggle joint mechanism 2. This profiled extremity has a cut that reveals the receiving recess 22, the releasing ramp 23 and a point 36 being fitted in the receiving notch 18 and blocked in this position by the locking element 21.

The reciprocating device 9 also includes a second link or unlocking rod 37, which is articulately mounted at one of its extremities on an axle 38 and engages the axle 35 in a longitudinal slot 39 allowing for its transversal displacement. The unlocking rod 37 could as well comprise a longitudinal slot in its back part, which would provide an identical result.

The unlocking rod 37 carries an unlocking spring 40 maintained by supports 41 and 42.

The assembly also comprises a remote control device for unlocking, which includes an unlocking intermediary lever 43 which is pivotally mounted and set in motion by pressure means 44, for example of the electromagnetic type including a coil 45 with a plunger core 46.

The intermediary unlocking lever 43 has a generally angular outline with a return portion 47 having a double oblique ramp 48 allowing for action on the unlocking lever 43 at any moment during the operation.

Remote distance unlocking is caused by a low energy impulse supplied to the coil 45. The lever 43 performs a rocking motion, causing the unlocking lever 19 of the toggle joint mechanism to move by contact with its lug 20 on the double ramp 48.

Of course, another means could be provided to cause unlocking, such as, for example, a tensionless coil or any other electromechanical transducer in positive security or equivalent.

The axle 35 of the reciprocating device 9 is integral with the movable translation equipment which carries the clamping contacts of the switch. It could have a broader base with which the end of the retaining lever 13 comes into contact to constitute a blocking support.

Figure 4:
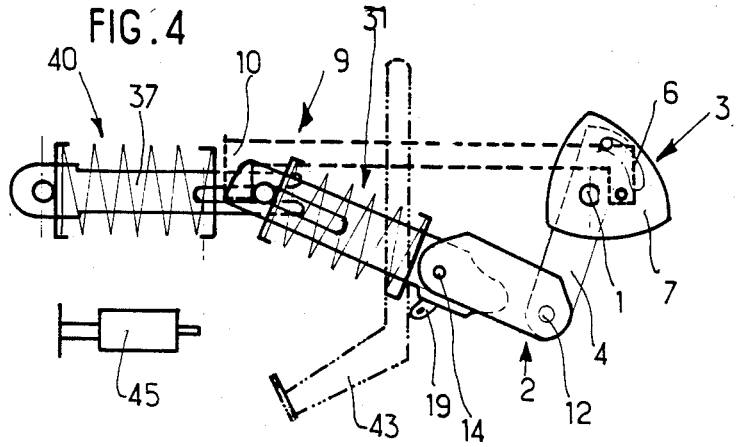
FIGS. 4 to 6 are schematic plan views, showing respectively in unlocked position, in intermediary position and in interlocked position, the complete mechanical assembly.
Figure 5:
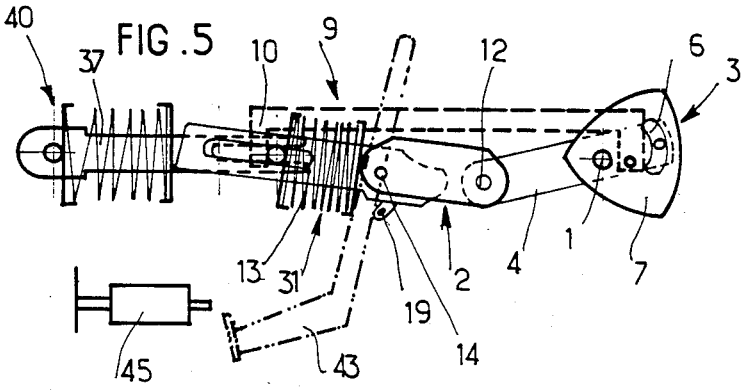
Figure 6:
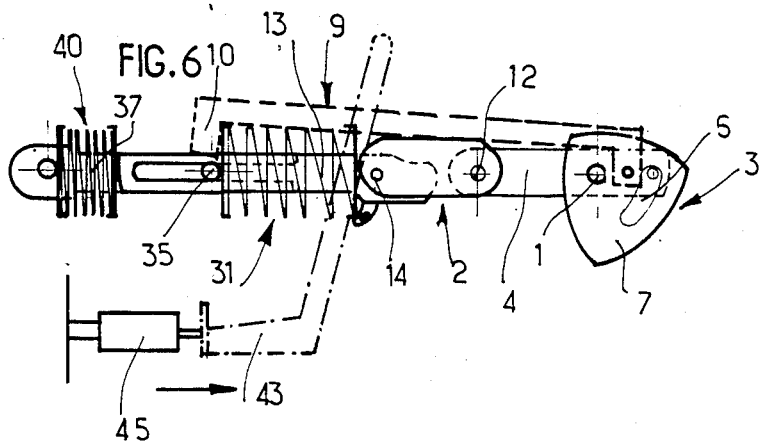

For a clearer understanding of the invention, the general operation of the mechanical assembly causing the sudden interlocking or unlocking will now be explained by referring more particularly to FIGS. 4 to 6.

The interlocking operation is commenced by acting on the operating handle to bring the axles of articulation 1, 12, and 14 of the toggle joint mechanism 2 and the axle 35 of the reciprocating device 9 in alignment.

Rotation of the handle produces, by means of the toggle joint mechanism 2 in its blocked state, a longitudinal type effort. The toggle joint mechanism 2 remains in its blocked state and transmits the effort to the interlocking spring 31 carried by the interlocking link 13. The push effort is then transmitted to the interlocking spring 31 which strikes, by its end support 32, against the axle 35 of the reciprocating device 9 retained in this position by the extremity of the retaining lever 10.

Compression is continued by pivoting of the action lever 4.

During all of this phase, displacement of the toggle joint mechanism 2 and, reciprocally, of the interlocking link 13, is translated by compression of the interlocking spring 31 between the two supports and simultaneously of the unlocking spring 37, until a portion of the toggle joint mechanism 2 strikes against the retainer lever 10 and drives it in a disengaging rocking motion. Thus released, the axle 35 is suddenly displaced into its interlocking position under the effect of the pushing spring 31. During this movement, the axle 35 is displaced in the slot 39 until it reaches its interlocking position, carrying along in translation the movable contact bearing equipment.

Unlocking is caused by an impulse to the device 44, which includes the coil 45 and the plunger core 46, or any other remote control equivalent means.

Displacement of the core 46 causes a turning motion of the intermediary unlocking lever 43, the double oblique ramp 48 of which enters into contact with the lug 20 of unlocking lever 19. The latter then pivots forwardly and brings its blocking transversal element in its disengaging position. The blocking lever 17 opens and releases the point 36 of the interlocking link 13 for pivoting. The collapse of the rectilinear connection is produced by a projection of the rod to the exterior. This movement is enhanced by the unlocking spring 37 which relaxes and causes sudden unlocking by displacement of the axle 35 into its extreme opposite position and collapsing of the toggle joint mechanism 2, and then its realignment or its automatic closing as will be seen below.

The retaining lever 10 is returned into its blocking position from the end of unlocking by the spring 11.

According to the present embodiment, the upper bearing 24 of the toggle joint mechanism 2 is provided on its large side 49 with a contact projection 50 which cooperates with a lug 51 provided on the actuating lever 4.

In addition, the interior part 52 of point 36 of the interlocking link 13 comprises a bulge 53 between its extremity and the ramp 23. The interior part 54 for returning the blocking lever 17 also comprises a bulge 55 behind the receiving notch 18.

Figures 11, 12, 13:
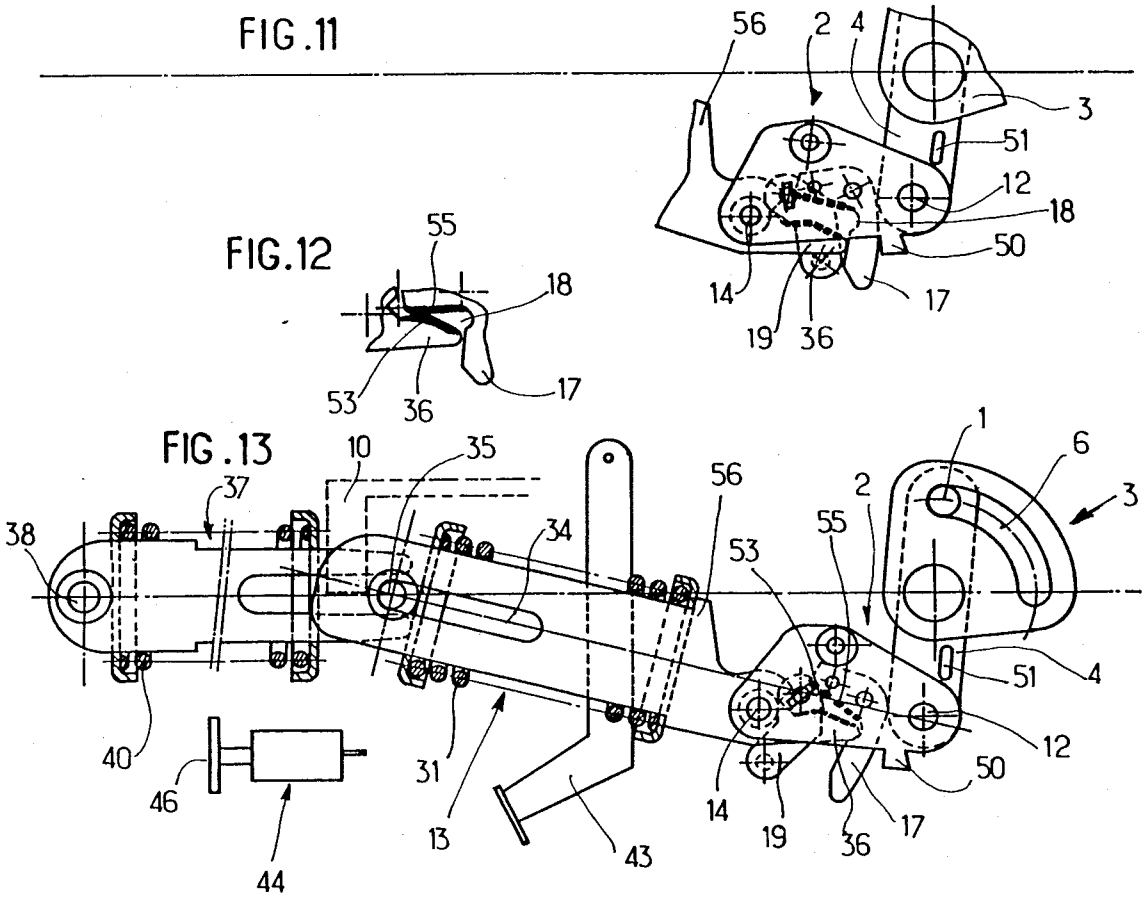
FIG. 11 is a detail plan view of the toggle joint mechanism showing the end of the pivoting operation of the acting lever of the toggle joint mechanism by the point of the interlocking link.
FIG. 12 is a detail plan view of the contact and of the thrust of the enlarged form of the point of the interlocking link with and against the return of the blocking lever of the toggle joint mechanism.
FIG. 13 is a plan view of the complete mechanical assembly at the end phase of automatic reengagement, realigned toggle joint mechanism switch ready to be reengaged.

These bulges 53 and 55 provide a guarantee of systematic perfect realignment of the toggle joint mechanism 2 solely by the interlocking energy under the effect of the push of the bulge 53 from the interior part 52 of the point 36 against the bulge 55 of the corresponding part 54 of the blocking lever 17, as is clearly shown in FIGS. 11, 12 and 13.

This closure aid proves to be completely effective in the folding back of the blocking lever 17.

Figure 7:
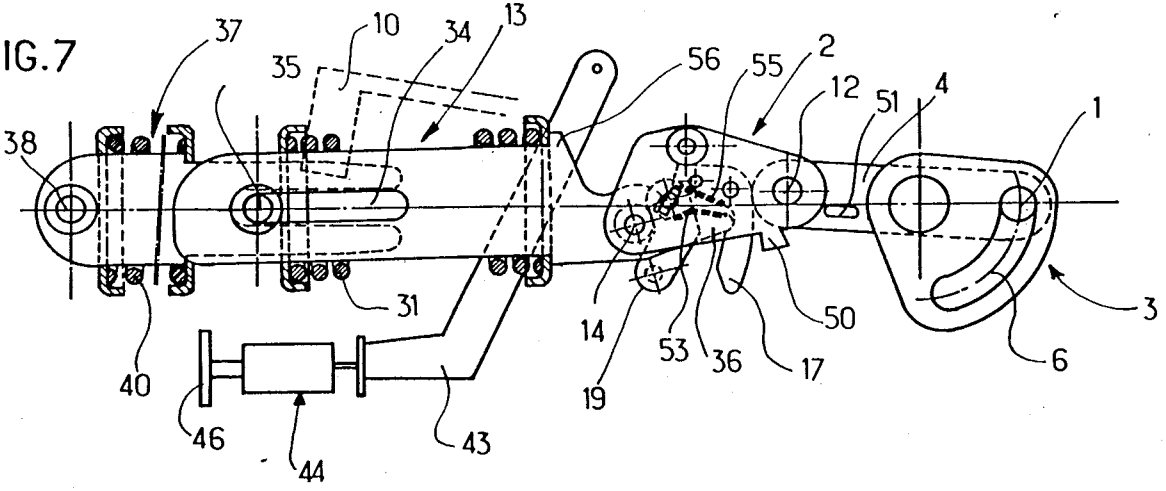
FIG. 7 is a plan view of the complete mechanical assembly, unlocked switch and aligned rod, just prior to unlocking according to the improvement according to this invention.
Figure 8:
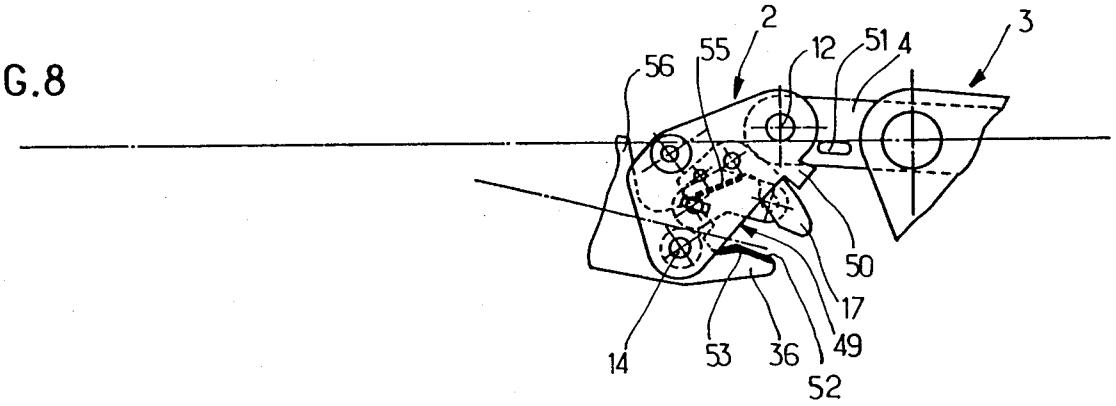
FIG. 8 is a detail plan view of the toggle joint mechanism just prior to unlocking according to the improvement according to the invention.
Figure 9:
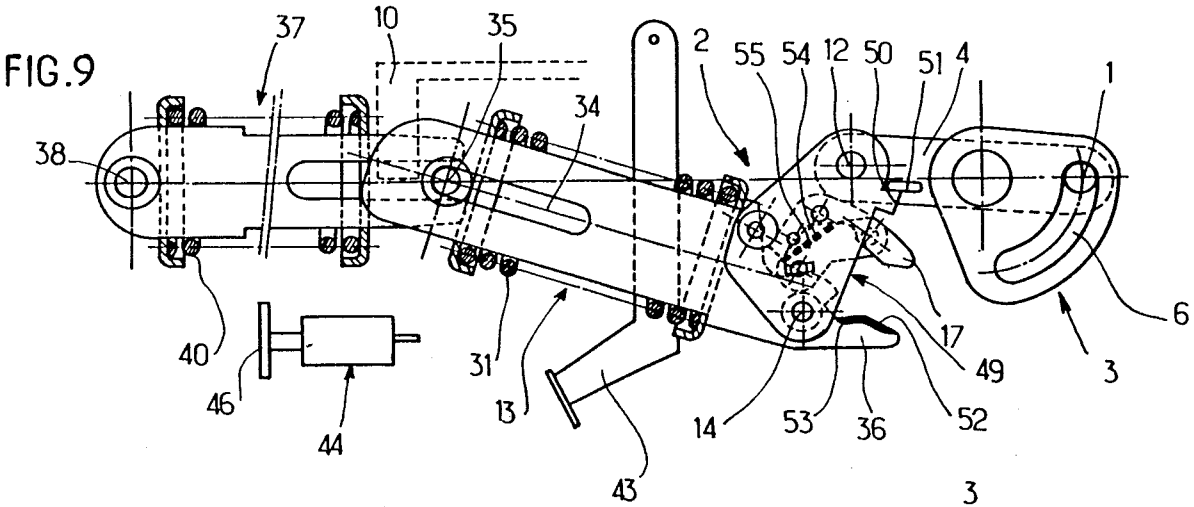
FIG. 9 is a plan view of the complete mechanical assembly when the projection of the toggle joint mechanism approaches its fixed piece.
Figure 10:
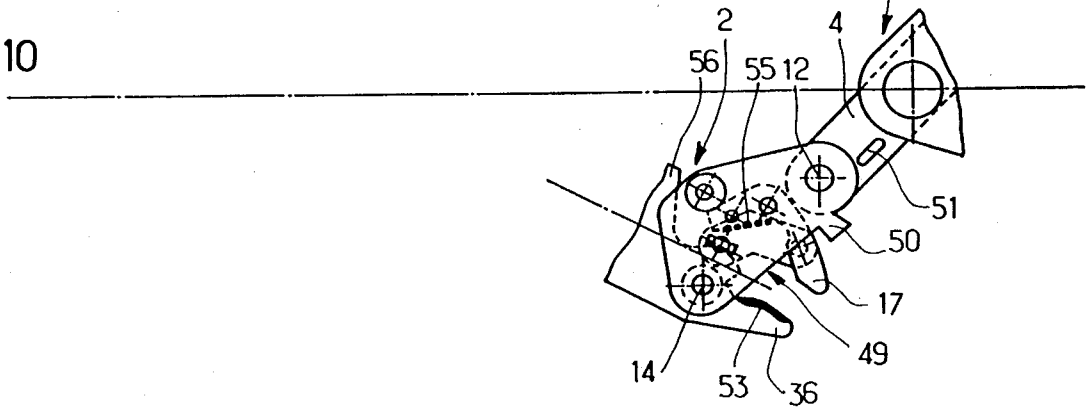
FIG. 10 is a detail plan view of the toggle joint mechanism according to the improvement of the invention in the pivoting phase of the operation lever which is integral with the operation handle.

The different operating phases of the automatic reinforced assembly are the following: after unlocking, the previously aligned toggle joint mechanism 2 (FIG. 7) collapses (FIG. 8) until contact of the projection 50 against the lug 51. The lateral extremity 56 of the interlocking link 13 strikes against the body of the toggle joint mechanism 2 and, by reaction, causes the actuating lever 4 to pivot downwardly (FIGS. 9 to 10) while the extremities of the interlocking link 13 and of the blocking lever 17 are getting closer until crossing of the blocking lever 17 by the point 36 of the interior ramp (FIG. 11).

After this crossing, the point 36 pushes in its folding movement, due to the presence of the bulges 53 and 55, the back part of blocking lever 17, forcing it to come down and bring the toggle joint mechanism 2 into its closed position (FIG. 12).

At the end of the movement, the link points are aligned (FIG. 13) and the mechanical assembly is ready to be interlocked.

It is then sufficient to restore interlocking of the switch by action on the operation handle.

Unlocking energy is sufficient to automatically bring by sole reaction force, the point 36 of the interlocking link 13 under the blocking lever 17 of the toggle joint mechanism 2 in initial position ready for interlocking.

Of course, the same effect could be obtained by only one bulge 53 or 55 of sufficient thickness to allow for the same pressure.

Figure 14:
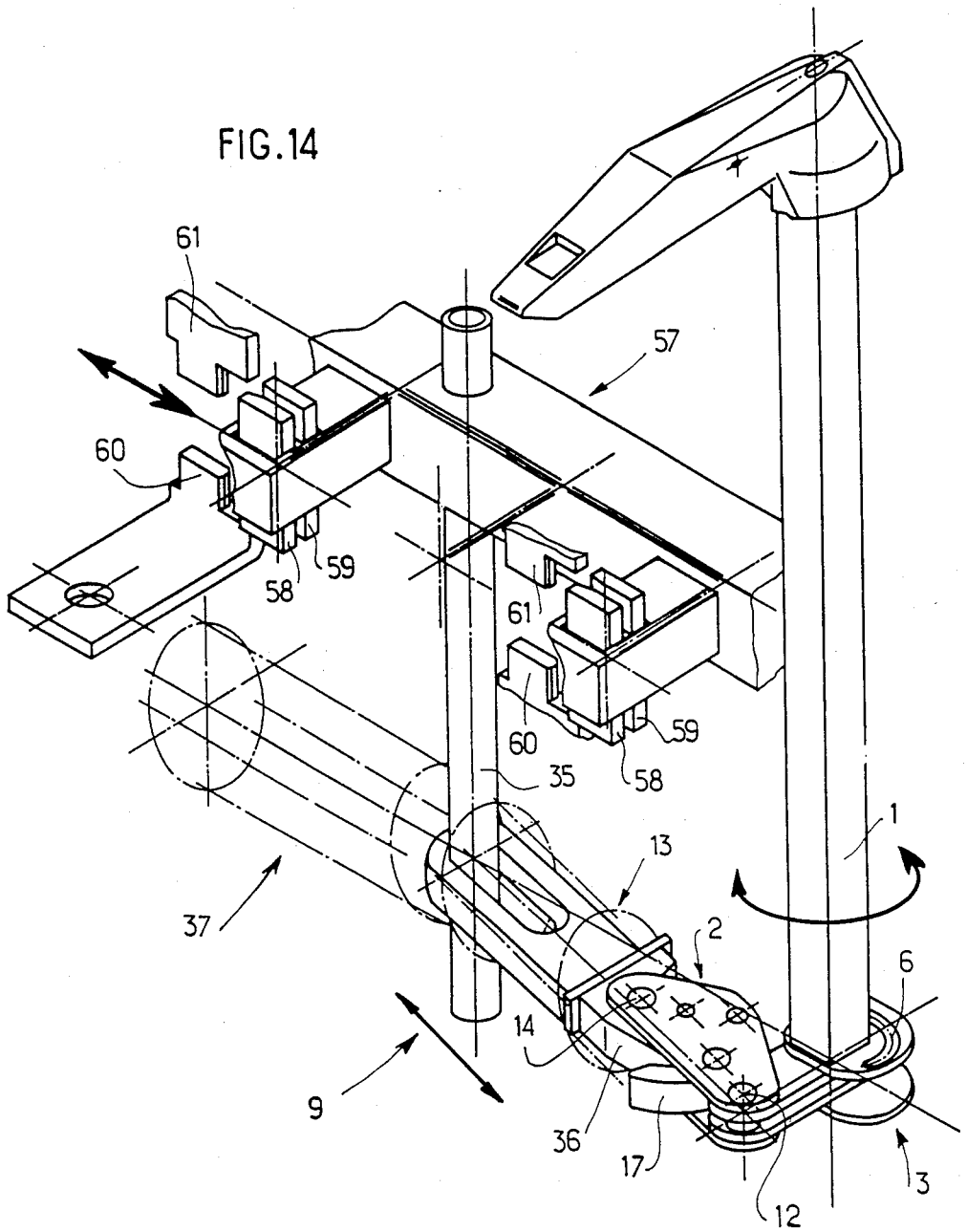
FIG. 14 is a general perspective view showing the general composition of the mechanical assembly for changing the rotational movement of the handle into a translation interlocking movement and the reciprocal translation unlocking movement.

FIG. 14 is a perspective view of the mechanism operating the translation switch. In this figure, it is clearly seen that the axle 35 is moved in translation from the turning movement of the handle, carrying along the contact-bearing movable equipment 57, the pieces 58 and 59 of which come to enclose contact blades 60 and 61 in a closing position.

Although the invention has been described in relation to a particular construction, it is of course understood that it should not be limited by it, and that various simple modifications, direct variations, substitutions of materials or equivalent means should not be excluded from the present protection but, on the contrary, they are fully embraced within its scope.

What we claim is:

1. Automatic reinforced and remote controlled arrangement for sudden interlocking and unlocking of a translation switch including two contact elements at least one of which is mounted on a support for translatory movement toward and away from the other, comprising an axle rotatably mounted on the support;

a manually controlled operating handle mounted on said axle for joint rotation therewith;

a control lever mounted on said axle for joint rotation therewith and having a fixed lug;

means for converting the rotation of said lever into translation of the one contact element, including a releasable toggle joint mechanism which is articulated to said lever, is automatically reactuated after unlocking movement, and includes two parallel plates one including an upper bearing having a large side provided with a contact projection cooperating with said fixed lug;

an elbow-shaped blocking lever pivotably mounted on said plates and having a receiving notch, an end portion, and an internal part;

an unlocking lever pivotably mounted on said plates and having and end lug, and an elongated straight locking element carried by said unlocking lever and extending transversely of said plates and cooperating with said internal part of said blocking lever;

reciprocating means having two extremities, one articulated to the support and the other to said toggle joint mechanism, said other extremity having a receiving recess partially delimited by a release ramp and cooperating with said locking element, and said reciprocating means including an interlocking link and an unlocking link, each having a median longitudinal slot therein and said interlocking link including a point having an internal part, and respective pusher means on each of said links, including respective interlocking and unlocking compression springs, and a common axle integral with the one contact element and received in said longitudinal slots of said links for movement along said links in perfect translation movements when said links come in alignment position;

means for energizing said pusher means of said interlocking link during the interlocking, including a limit mechanism which includes a retainer lever mounted on the support for turning toward and out of a blocking position and biased towards said blocking position and having an extremity in the path of movement of and remaining in blocking contact with said axle during the compression phase of said interlocking spring, and releasing said interlocking spring under the pushing action of said toggle joint mechanism when the latter has reached a position of alignment, for sudden displacement of said axle along said slot of said interlocking link until said axle reaches its interlocking position, and means for energizing said pusher means of said unlocking link, including remote locking means acting on said unlocking lever of said toggle joint mechanism, at least one of said internal parts being provided with a bulge allowing for automatic realignment of the toggle joint mechanism solely by the energy of the sudden unlocking in order to permit interlocking.

2. The arrangement according to claim 1, wherein said remote unlocking means is an electromagnet including a coil and a plunger core received in said coil for displacement, and a pivotable intermediary lever extending into the path of movement of said plunger core to be pivoted thereby and actuating said unlocking lever of the toggle joint mechanism.

3. The arrangement according to claim 1, wherein said internal part is that of said point of said interlocking link.

4. The arrangement according to claim 1, wherein said internal part is that of said point of said blocking lever.

5. Automatic reinforced and remote controlled arrangement for sudden interlocking and unlocking of a translation switch including two contact elements at least one of which is mounted on a support for translatory movement toward and away from the other, comprising a manually controlled lever rotatably mounted on the support;

means for converting the rotation of said lever into translation of the one contact element, including a releasable toggle joint mechanism which is articulated to said lever, is automatically reactuated after unlocking movement, and includes an unlocking lever;

reciprocating means having two extremities, one articulated to the support and the other to said toggle joint mechanism, said reciprocating means including an interlocking link and an unlocking link, each having a median longitudinal slot which is open at one of its ends, and respective pusher means on each of said links, including respective interlocking and unlocking compression springs, and a common axle integral with the one contact element and received in said longitudinal slots of said links for movement along said links in perfect translation movements when said links come in alignment position;

means for energizing said pusher means of said interlocking link during the interlocking, including a limit mechanism, and means for energizing said pusher means of said unlocking link, including remote locking means acting on said unlocking lever of said toggle joint mechanism.

6. The arrangement according to claim 5, wherein said limit mechanism includes a pivotable retainer lever mounted for elastic return towards its blocking position and having an extremity in the path of movement of and remaining in blocking contact with said axle during the compression phase of said interlocking spring, and releasing said axle under the pushing action of said toggle joint mechanism when the latter has reached a position of alignment, for sudden displacement of said axle along said slot of said interlocking link until said axle reaches its interlocking position.

7. The arrangement according to claim 5, wherein said remote unlocking means is an electromagnet including a coil and a plunger core received in said coil for displacement, and a pivotable intermediary lever extending into the path of movement of said plunger core to be pivoted thereby and actuating said unlocking lever of the toggle joint mechanism.

8. Automatic reinforced arrangement for sudden interlocking of a translation switch, comprising a toggle joint mechanism including an upper bearing having a large side provided with a contact projection, and a blocking lever pivotally carried by said upper bearing and having an internal part;

an operating handle;

a control lever for moving the switch connected to said operating handle for joint movement therewith and having a fixed lug cooperating with said contact projection; and an interlocking link pivotally connected to said toggle joint mechanism including a point for cooperating with the blocking lever to lock the toggle joint mechanism, said point having an internal part, at least one of said internal parts being provided with a bulge allowing for automatic realignment of the toggle joint mechanism and the interlocking link solely by the energy of the sudden unlocking in order to permit the blocking lever to again cooperate with the point of the interlocking link to relock the toggle joint mechanism.

9. The arrangement according to claim 8, wherein said internal part is that of said point of said interlocking link.

10. The arrangement according to claim 8, wherein said internal part is that of said blocking lever.

* * * * *